US009171684B2

(12) United States Patent
Bunk et al.

(10) Patent No.: US 9,171,684 B2
(45) **Date of Patent: *Oct. 27, 2015**

(54) CIRCUIT BREAKER LATCHING MECHANISM

(71) Applicant: Siemens Aktiengesellschaft, Munich (DE)

(72) Inventors: Thomas Bunk, Sulzbach-Rosenberg (DE); Siegfried Pirker, Ensdorf (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 113 days.

This patent is subject to a terminal disclaimer.

(21) Appl. No.: 13/766,963

(22) Filed: Feb. 14, 2013

(65) Prior Publication Data

US 2013/0228428 A1 Sep. 5, 2013

(30) Foreign Application Priority Data

Mar. 2, 2012 (DE) ..... 10 2012 203 294

(51) Int. Cl.

| | |
|---|---|
| ***H01H 1/52*** | (2006.01) |
| ***H01H 9/20*** | (2006.01) |
| ***H01H 71/50*** | (2006.01) |
| ***H01H 71/52*** | (2006.01) |
| *H01H 71/10* | (2006.01) |

(52) U.S. Cl.

CPC ..... *H01H 9/20* (2013.01); *H01H 71/505* (2013.01); *H01H 71/525* (2013.01); *H01H 71/1054* (2013.01); *H01H 2071/506* (2013.01); *H01H 2071/508* (2013.01)

(58) Field of Classification Search

USPC ..... 200/322, 401, 318, 39 R, 43.16, 411, 200/425, 470; 335/172, 167, 21

See application file for complete search history.

(56) References Cited

U.S. PATENT DOCUMENTS

| | | | | |
|---|---|---|---|---|
| 5,213,206 | A * | 5/1993 | Beck et al. | 200/401 |
| 5,300,907 | A | 4/1994 | Nereau et al. | |
| 5,430,422 | A | 7/1995 | Gibson | |

(Continued)

FOREIGN PATENT DOCUMENTS

| | | | |
|---|---|---|---|
| DE | 69306822 | T2 | 5/1997 |
| DE | 102006059307 | B3 | 2/2008 |

(Continued)

OTHER PUBLICATIONS

German Search Report dated Jan. 15, 2013.

*Primary Examiner* — Vanessa Girardi

(74) *Attorney, Agent, or Firm* — Harness, Dickey & Pierce, P.L.C.

(57) ABSTRACT

A circuit breaker includes a latching mechanism including a switching mechanism operatively connected to a tensioning element, and an unlatching mechanism by which, in response to a tripping signal, the tensioning element can be transferred from a tensioned state into an at least substantially relaxed state. The tensioning element is indirectly coupled to a tension lever which can be locked or tripped as a function of a position of a blocking pawl of the unlatching mechanism and which includes a blocking mechanism by which, in an OFF position of the latching mechanism in which the switch is open and the tensioning element is tensioned, tripping of the tension lever is prevented despite a tripping signal. The blocking mechanism of the tension lever includes a rocker arm which is fastened movably on the tension lever.

13 Claims, 10 Drawing Sheets

(56) References Cited

U.S. PATENT DOCUMENTS

| | | | | |
|---|---|---|---|---|
| 6,218,919 | B1 * | 4/2001 | Ciarcia et al. | 335/167 |
| 6,479,774 | B1 * | 11/2002 | Castonguay et al. | 200/401 |
| 8,604,374 | B2 * | 12/2013 | Mittelstadt | 200/401 |
| 8,975,990 | B2 * | 3/2015 | Godesa | 335/167 |
| 2003/0197581 | A1 * | 10/2003 | O'Keeffe et al. | 335/172 |
| 2013/0228430 | A1 * | 9/2013 | Bunk et al. | 200/400 |

FOREIGN PATENT DOCUMENTS

| | | | |
|---|---|---|---|
| DE | 102009007478 | A1 | 8/2010 |
| DE | 102009047478 | A1 | 6/2011 |
| EP | 0555158 | A1 | 8/1993 |

* cited by examiner

CIRCUIT BREAKER LATCHING MECHANISM

PRIORITY STATEMENT

The present application hereby claims priority under 35 U.S.C. §119 to German patent application number DE 10 2012 203 294.0 filed Mar. 2 2012, the entire contents of which are hereby incorporated herein by reference.

FIELD

At least one embodiment of the invention generally relates to a circuit breaker having a latching mechanism.

BACKGROUND

Latching mechanisms comprise on the one hand a switching mechanism for opening and closing a switch contact which is in operative contact with a tensioning element, and on the other hand an unlatching mechanism by which, in response to a tripping signal, the tensioning element can be transferred from a tensioned state into an at least substantially relaxed state in order in this way to open the switch contact.

Circuit breakers are special switches which are usually designed for high currents. These switches are not only able to switch operating currents and low overload currents, but in the event of errors can also switch on high overload currents and short-circuit currents, hold these fault currents for a predetermined time and switch them off again. Depending on embodiment variant, circuit breakers are implemented as single-pole or multi-pole.

Circuit breakers generally comprise so-called latching mechanisms which, when unwanted operating states occur, in particular in the case of short circuits, cause an electric circuit to be disconnected.

A latching mechanism is a mechanical apparatus which preferably enables an electric circuit to be disconnected. Toward that end the force of a tensioned spring which was tensioned by means of a tensioning mechanism at the time of switching on is usually released in order to open the switch contact. The typical tripping criterion is a current with a presettable current intensity by means of which the latching mechanism action is tripped with the aid of an electromagnet or of a self-heating bimetallic strip.

A circuit breaker latching mechanism comprises two essential areas. On the one hand, a switching mechanism is provided by way of which an electrical switch contact is opened and closed upon exposure to spring force. On the other hand, a latching mechanism of said kind comprises an unlatching mechanism which, when a tripping criterion is fulfilled, releases the energy stored in a spring of the switching mechanism, as a result of which the latching mechanism is tripped and the electrical switch contact is opened.

In this connection, solutions are known from the prior art which are intended to prevent the latching mechanism being tripped in the OFF position. Thus, for example, DE 693 06 822 T2 describes a circuit breaker latching mechanism comprising a so-called test button, the actuation of which ensures that the latching mechanism also does not trip in the OFF position. To this end, in the OFF position of the latching mechanism, the tensioning bolt mounted in the actuating lever slides onto a blocking contour on the tension lever, so that the latter is locked and in no event releases the latching mechanism or the switch. This makes it possible to press the test button and then actuate the tripping shaft without the latching mechanism being tripped. In this way the switching mechanism is kept in a pretensioned state even in the case of unintentional tripping.

SUMMARY

The inventors discovered that an aspect of the above-described technical solution is the fact that a blocking contour is provided on the tension lever, the blocking contour being required in order to lock the unlatching mechanism in the OFF position of the latching mechanism. Hence, the geometry of the tension lever and its pivot point are not freely selectable but instead the blocking contour provided on the blocking lever always has to be taken into account. Accordingly, the known locking mechanisms for the OFF positions should generally only be used for a limited number of latching mechanisms each having the same latching mechanism kinematics.

On the basis of this, an embodiment of the invention is directed to a latching mechanism of a circuit breaker in such a way that the latching mechanism remains in the OFF position even following unintentional tripping in the tensioned position. The technical solution to be disclosed is intended to be implemented using relatively simple structural means and at reasonable cost. In addition it should be possible to use the latching mechanism for virtually any type of related latching mechanism kinematics.

A latching mechanism is disclosed for a circuit breaker. Advantageous embodiment variants of the invention are the subject matter of the dependent claims and will be explained in more detail in the following description, sometimes with reference to the figures.

A circuit breaker is disclosed with a latching mechanism comprising a switching mechanism for opening and closing a switch contact which is operatively connected to a tensioning element, and an unlatching mechanism by way of which, in response to a tripping signal, the tensioning element can be transferred from a tensioned into an at least substantially relaxed state in such a way that the switch contact is opened thereby. The tensioning element is here indirectly coupled to a tension lever which can be locked or released as a function of a position of a blocking pawl of the unlatching mechanism. The tension lever also comprises a blocking mechanism by means of which, in an OFF position of the latching mechanism in which the switch is open and the tensioning element is tensioned, tripping of the tension lever is prevented despite a tripping signal.

BRIEF DESCRIPTION OF THE DRAWINGS

The invention is described in more detail below, without restricting the general inventive concept, with the aid of example embodiments and with reference to the figures, in which.

DETAILED DESCRIPTION OF THE EXAMPLE EMBODIMENTS

Figure 1:
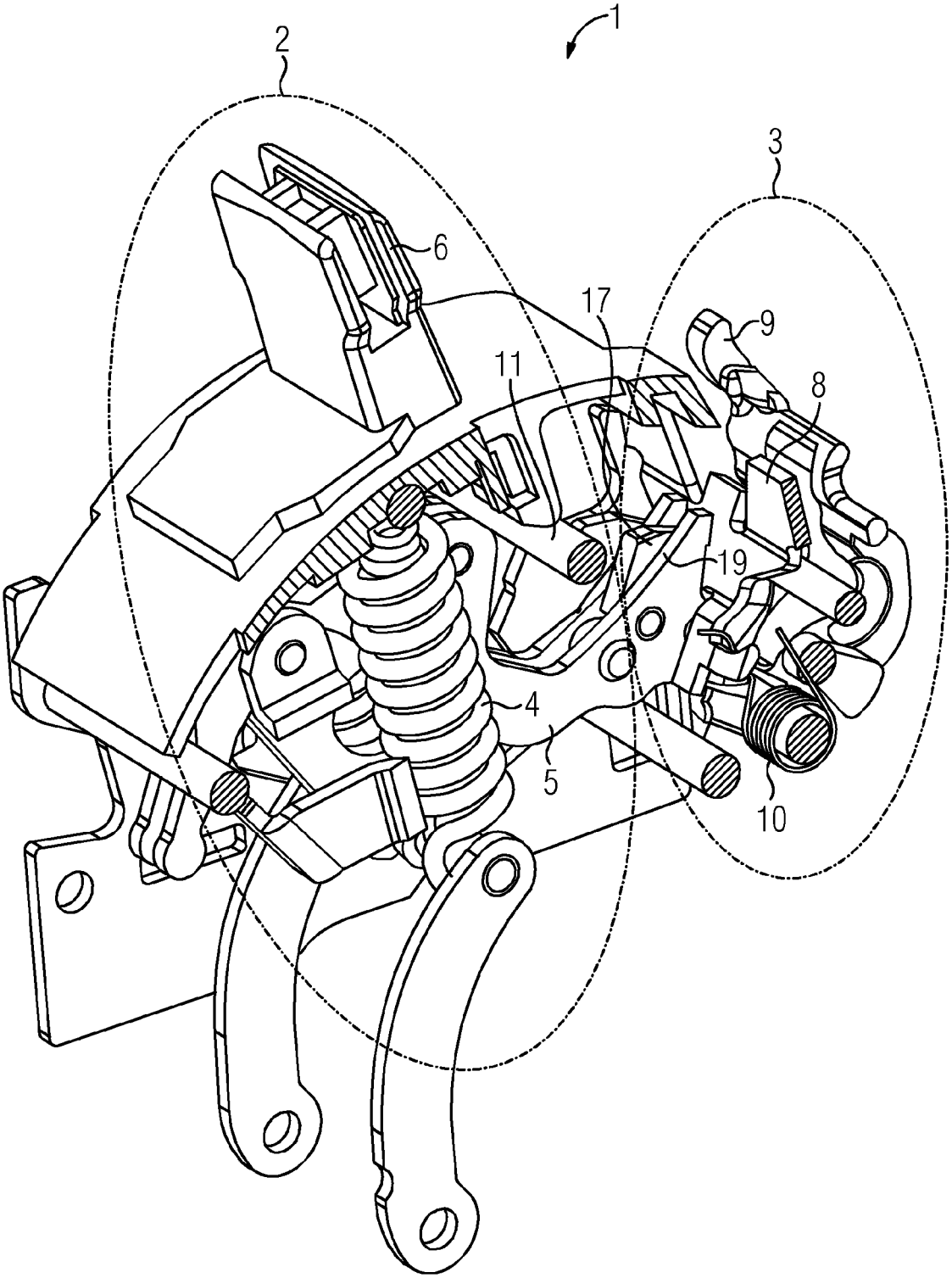
FIG. 1 shows a perspective view of a circuit breaker latching mechanism.

The present invention will be further described in detail in conjunction with the accompanying drawings and embodiments. It should be understood that the particular embodiments described herein are only used to illustrate the present invention but not to limit the present invention.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

A circuit breaker is disclosed with a latching mechanism comprising a switching mechanism for opening and closing a switch contact which is operatively connected to a tensioning element, and an unlatching mechanism by way of which, in response to a tripping signal, the tensioning element can be transferred from a tensioned into an at least substantially relaxed state in such a way that the switch contact is opened thereby. The tensioning element is here indirectly coupled to a tension lever which can be locked or released as a function of a position of a blocking pawl of the unlatching mechanism. The tension lever also comprises a blocking mechanism by means of which, in an OFF position of the latching mechanism in which the switch is open and the tensioning element is tensioned, tripping of the tension lever is prevented despite a tripping signal.

The blocking mechanism of the tension lever comprises a rocker arm which is fastened movably on the tension lever.

Hence, a feature of a latching mechanism according an embodiment of the invention is that a movable rocker arm is provided on the tension lever, which rocker arm, in the OFF position, reliably prevents tripping of the latching mechanism. The rocker arm is in this case embodied in such a way that it is used exclusively for blocking the latching mechanism in the OFF position.

As soon as the electrical switch contact is switched off or opened, the circuit breaker latching mechanism is transferred into the OFF position, wherein the tensioning element of the switching mechanism still remains in the tensioned state. The rocker arm mounted rotatably on the tension lever is now used to ensure that the tension lever is locked in such a way that, even in the event of an actuation of the tripping shaft, the tension lever does not move and hence the tensioning element of the switching mechanism is also not relaxed.

In an embodiment of the invention, a tensioning bolt mounted in the actuating lever slides onto a blocking contour of the rocker arm as soon as the latching mechanism is transferred into the OFF position upon the opening of the switch contact. Since the torque now introduced into the tension lever via the rocker arm is greater than the torque introduced via the tension spring of the switching mechanism, the tension lever in the OFF position is preferably pressed downward, so that the end of the blocking pawl no longer bears on the stopping face of the tension lever, which is used for the latching of the two components. Since in this case the tension lever is locked and the blocking pawl is relaxed and no longer in engagement with the tension lever, the test button can now be pressed or the tripping shaft actuated, without the latching mechanism being tripped.

As soon as the tripping shaft of the unlatching mechanism has been actuated, regardless of whether this takes place via a tripping action or actuation of the test button, the latching mechanism or the unlatching mechanism has to undergo a reset operation before being transferred back to the ON position. With a reset operation of this kind, the tripped latching mechanism, in particular the unlatching mechanism, is reactivated.

Preferably the rocker arm is mounted movably on the tension lever in such a way that, as soon as a reset operation is initiated, a reset contour on the tension lever becomes free and the tensioning bolt mounted in the actuating lever can slide over the reset contour. This causes the tripping shaft to be returned to an initial tensioned state. After the end of the reset operation, the latching mechanism can, if required, be returned to the ON position by actuating the actuating lever.

In a special embodiment variant of the invention it is provided that the rocker arm is mounted on the tension lever in such a way that the rocker arm is at least partially folded back behind the tension lever so that the reset contour on the tension lever is freely accessible to the tensioning bolt.

The forced resetting of the rocker arm effected by the tensioning bolt ensures the free movement/smooth running of the component in order to return the rocker arm to the engagement position on the subsequent swinging-in of the blocking pawl. According to a special development, the tension lever is implemented in at least two parts and comprises two plane-parallel side parts between which the rocker arm is retracted immediately before or at the start of the reset operation.

FIG. 1 is a perspective view of the latching mechanism 1 of a circuit breaker. Here, the latching mechanism 1 shown comprises two main assemblies, namely the switching mechanism 2 on the one hand and the unlatching mechanism 3 on the other. The switching mechanism 2 brings the electrical switch contact of the circuit breaker into operative connection with a spring 4 used as an energy store in such a way that, with a closed contact, the spring 4 is tensioned and, when the latching mechanism 1 is tripped, the energy stored in the spring 4 is released so that the contact is opened by the spring force acting thereupon.

The unlatching mechanism 3 is provided in order on the one hand to hold the spring 4 reliably in the tensioned state and on the other hand to enable reliable and rapid tripping of the latching mechanism to be ensured.

The connection between the switching mechanism 2 with the tension spring 4 and the unlatching mechanism 3 is established by way of a tension lever 5 which can be blocked or released by the unlatching mechanism 3 as required. As soon as the tension lever 5 is released by the unlatching mechanism 3, the spring 4 relaxes and the electrical switch contact opens.

The catch spring 10 is an essential component of the unlatching mechanism 3, said spring acting on the blocking pawl 8 in such a way that the end of the blocking pawl 8 is moved toward a stopping face of the tension lever 5 provided for this purpose in order to lock the tension lever 5. In addition, a tripping shaft 9 is provided in the unlatching mechanism 3 and when a tripping criterion is fulfilled, in particular as soon as the current in the switch reaches a predetermined current intensity, said tripping shaft is set into a rotary or swiveling motion by an actuator. The movement of the tripping shaft 9 causes it to come into contact with the blocking pawl 8 in such a way that the blocking pawl 8 is also swiveled and hence the force from the end of the blocking pawl 8 acting on the stopping face of the tension lever 5 is reduced. The reduction of the force from the blocking pawl 8 acting on the stopping face of the tension lever 5 also causes the locking of the tension lever 5 to be released, the spring 4 to be relaxed and the switch contact to open.

The different switching states of the latching mechanism 1 are explained in detail below.

Figure 3:
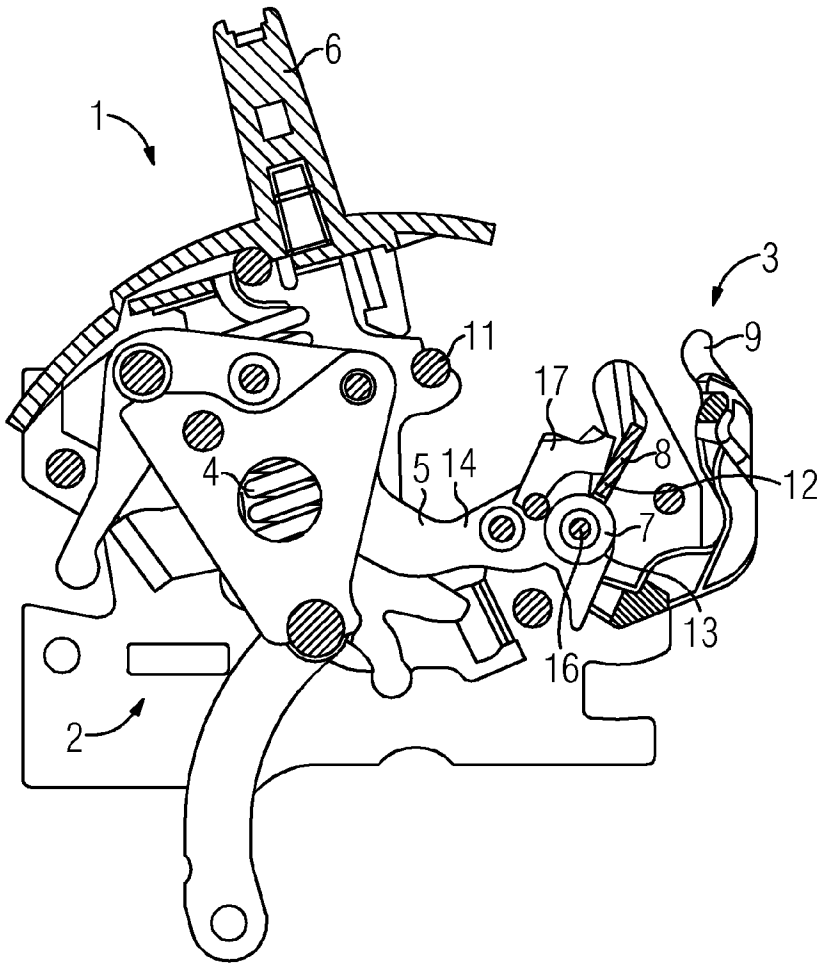
FIGS. 2 to 5 show different views of a latching mechanism in the ON position.
Figure 2:
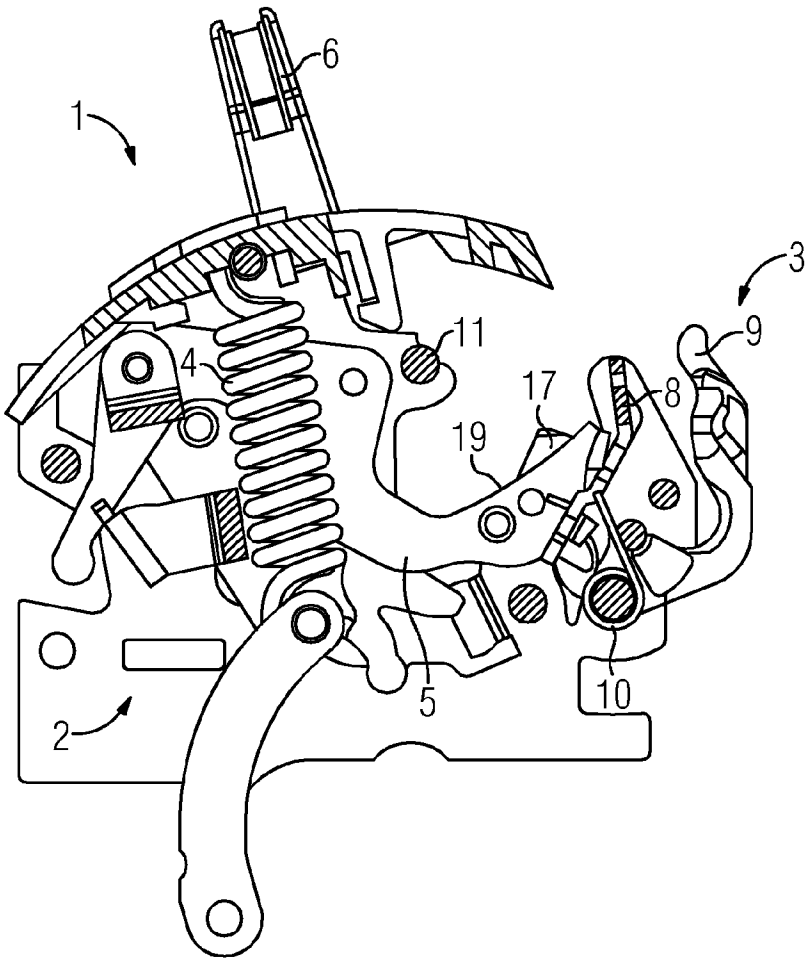
Figure 5:
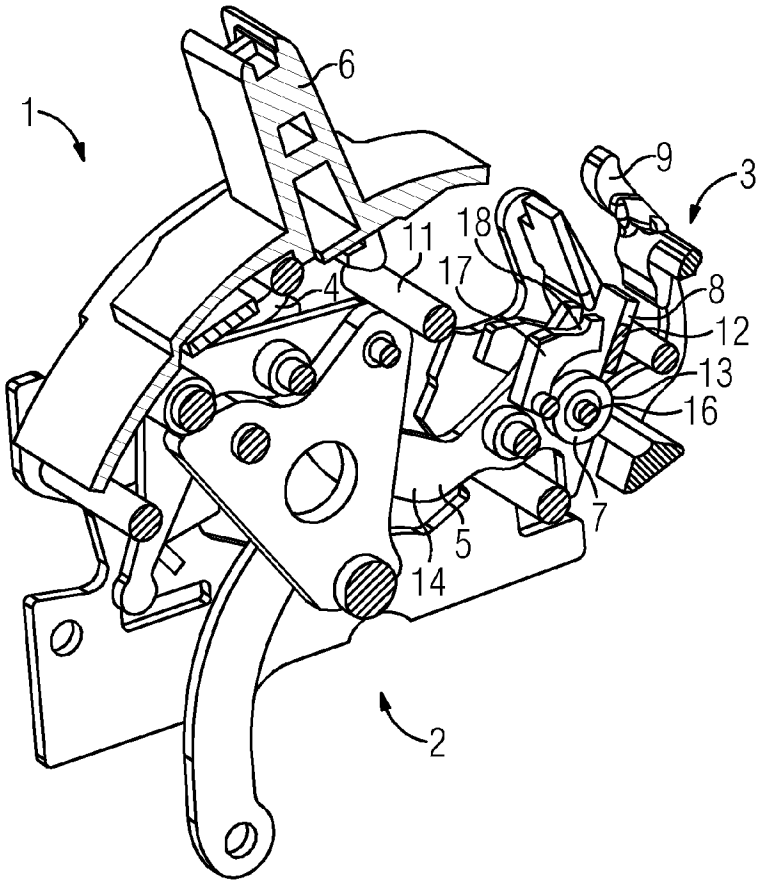
Figure 4:
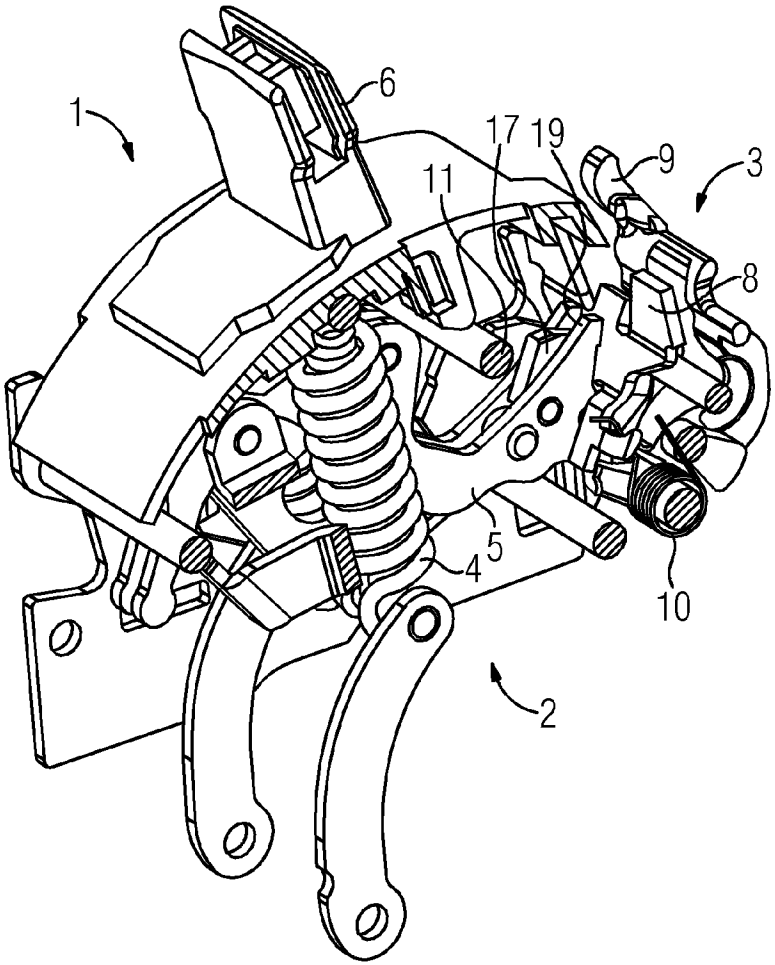

FIGS. 2 to 5 show the latching mechanism 1, the components of which have already been explained in more detail with reference to FIG. 1, in an ON position. FIGS. 2 and 3 show the latching mechanism in a side view, while FIGS. 4 and 5 are a perspective view, FIGS. 4 and 5 each showing the latching mechanism in a cutaway view. In these cutaway views, the latching mechanism 1 is divided along the plane of symmetry and in each case only the components provided in the rear part are shown. In this way FIGS. 3 and 5 show the rear side part 14 of the tension lever 5, the roller 7 mounted thereon, the rocker arm 17 and the end 12 of the blocking pawl 8.

In the ON position, the switch is closed, the spring 4 tensioned and the latching mechanism 1 is in the blocked state.

In addition, the unlatching mechanism 3, and hence also the latching mechanism 1, is in the tensioned state, with the end 12 of the blocking pawl 8 being in contact with the outer circumference of a roller 7 mounted rotatably on the tension lever 5 in the area of the stopping face 13. The blocking pawl 8 hence locks the tension lever 5 in the position shown so that the spring 4 is tensioned and the electrical switch contact is closed.

Figure 7:
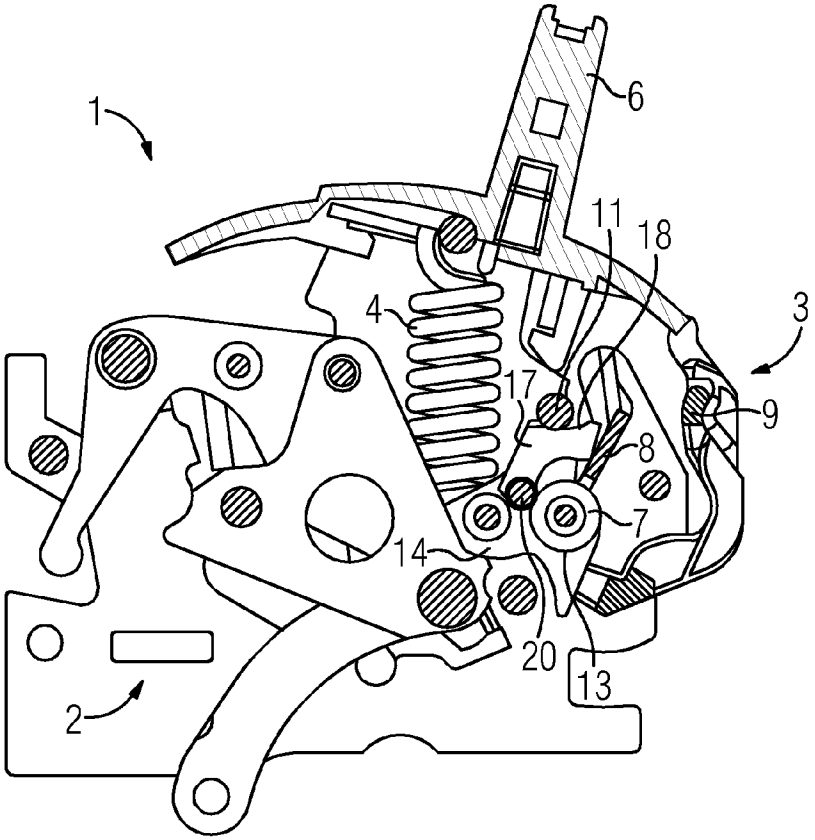
FIGS. 6 to 7 show a latching mechanism in the OFF position.
Figure 6:
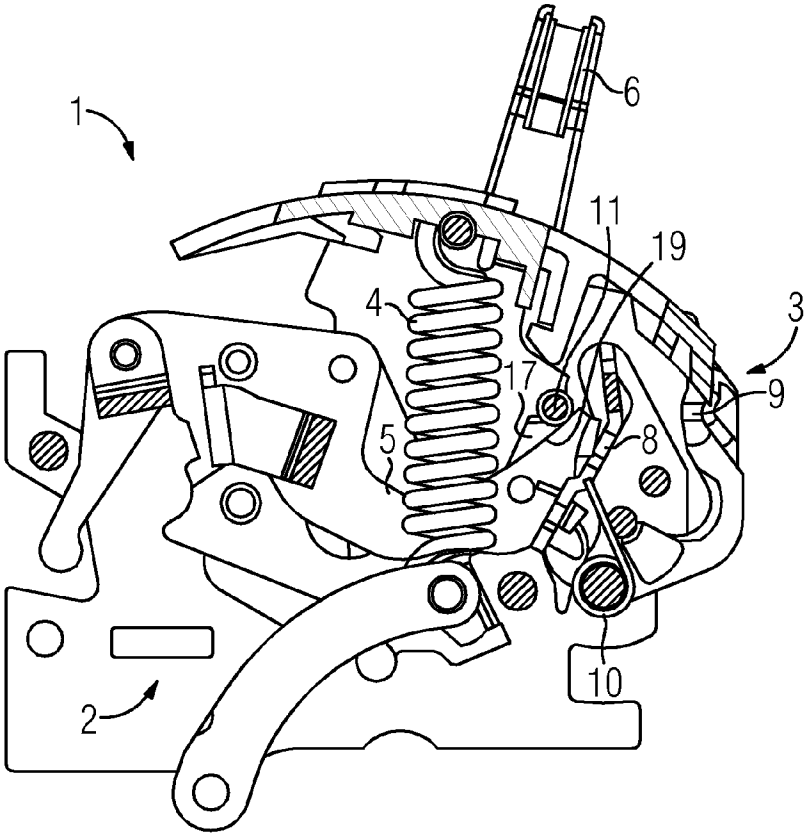

FIGS. 6 and 7 show a side view of a latching mechanism 1 according to an embodiment of the invention, with the entire latching mechanism 1 being shown in FIG. 6 and only the rear part being shown in FIG. 7. FIG. 7 is hence a sectional view in which the section extends along a plane between the two side parts 14, 15 of the tension lever 5.

In order to transfer the latching mechanism into the OFF position, the actuating lever 6 is moved to the right so that a tensioning bolt 11, which is mounted in the actuating lever 6, is brought into contact with the blocking contour 18 of the rocker arm. Due to the rocker arm 17, the torque introduced via the actuating lever 6 into the tension lever 5 is greater than the torque of the tensioning elements of the switching mechanism 2 which are implemented as tension springs 4. This causes the tension lever 5 to be pressed slightly downward and the latching between the end 12 of the blocking pawl 8 and the stopping face 13 of the tension lever 5 to be relaxed. As FIG. 7 shows, an air gap is formed between the blocking pawl 8 and the stopping face of the tension lever 5. In this embodiment variant the stopping face 13 of the tension lever 5 is formed by an outer circumferential surface of a roller 7.

Here, the roller is mounted rotatably around the bearing bolt 16 between the two plane-parallel side parts 14, 15 of the tension lever 5.

Figure 8:
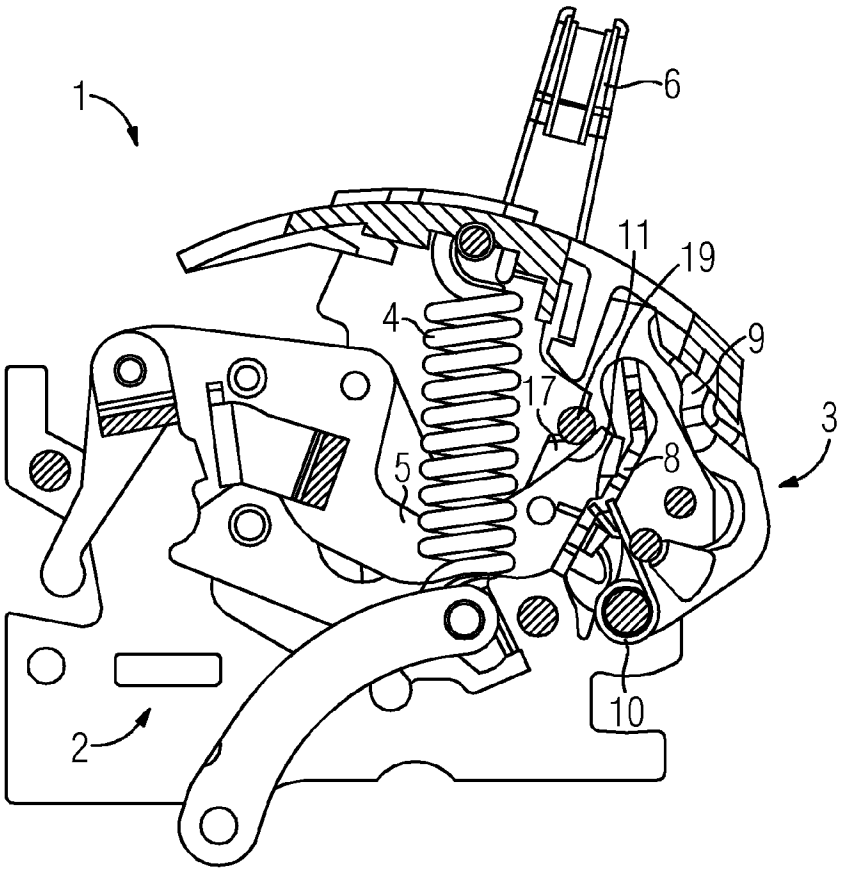
FIG. 8 shows a latching mechanism in the OFF position and actuation of the tripping shaft.

To supplement FIGS. 6 and 7, FIG. 8 shows the latching mechanism 1 of a circuit breaker in the OFF position upon actuation of the tripping shaft 9. Without the provision of additional blocking, the latching mechanism 1 would in this case be tripped by the release of the latching between blocking pawl 8 and stopping face 13. However, since the tensioning bolt 11 is engaged with the blocking contour 18 of the rocker arm 17, the tension lever 5 is pressed slightly downward and in this way locked in its position. As a result of the blocking of the latching mechanism 1 by means of the rocker arm 17 and the associated relaxation of the blocking pawl 8 of the unlatching mechanism 3, the test button can be pressed or the tripping shaft 9 actuated without the latching mechanism 1 or the switch being tripped.

Figure 9:
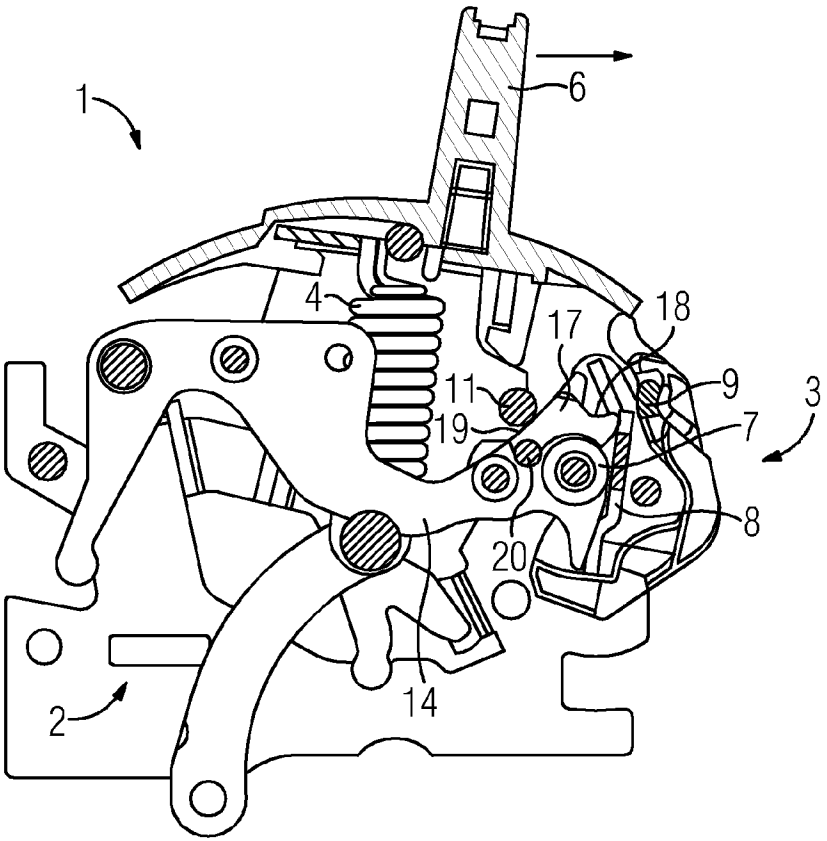
FIG. 9 shows a latching mechanism during the reset operation.

Regardless of whether the test button has been actuated or the latching mechanism 1 has been tripped in response to a tripping signal, it is necessary for a reset operation to be performed first in order to reactivate the latching mechanism 1 and in this case in particular the unlatching mechanism. In this connection, FIG. 9 shows a latching mechanism 1 of a circuit breaker implemented according to an embodiment of the invention during the reset operation.

To initiate the reset operation, the actuating lever 6 is moved by means of the handle in the direction of the arrow toward the right. This causes the tensioning bolt 11, which is mounted in the actuating lever 6, to move along the reset contour 19 of the tension lever 5. Here, the reset contour 19 of the tension lever 5 is freely accessible to the tensioning bolt 11, since the rocker arm 17 is swiveled downward between the two side parts 14, 15 of the tension lever 5.

Figure 11:
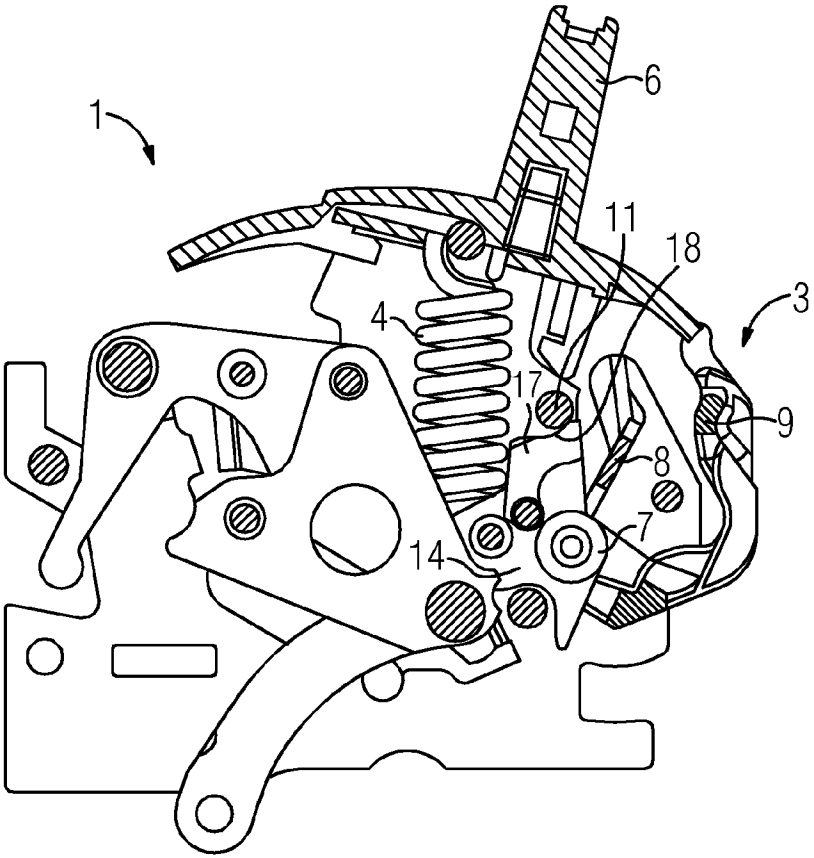
FIGS. 10 and 11 show a latching mechanism in the reset position.
Figure 10:
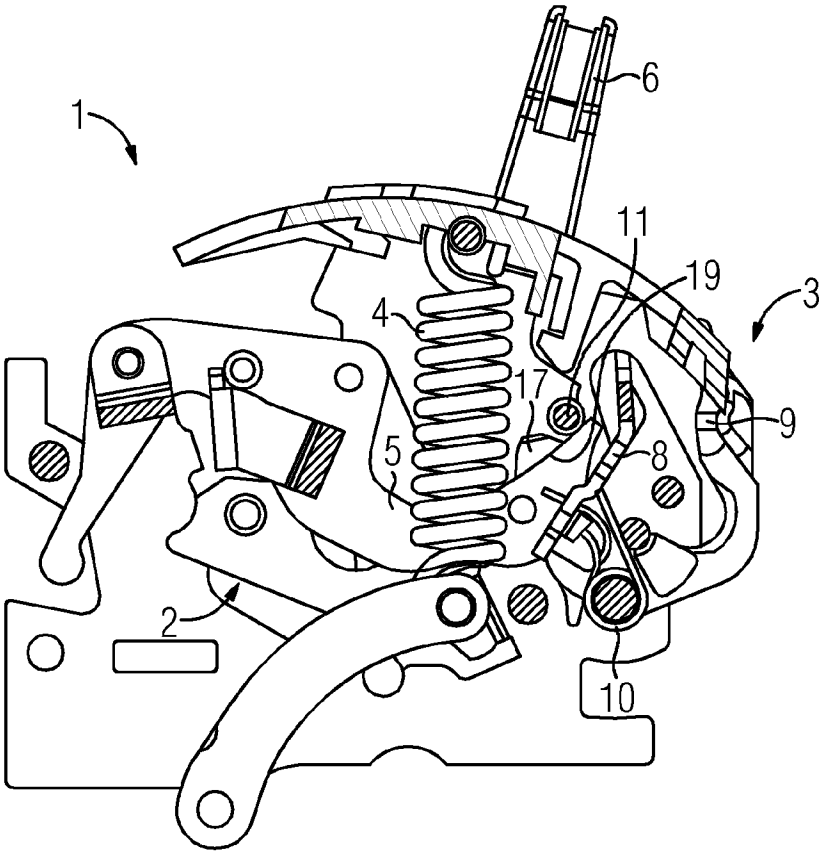

The movement of the tensioning bolt 11 along the reset contour 19 of the tension lever 5 causes said lever to be pressed downward. To supplement this, FIGS. 10 and 11 depict the latching mechanism 1 in the reset position, in which the tensioning bolt 11 has reached the outer end of the tension lever 5. In addition, the blocking pawl 8 is pressed by the catch spring 10, which is implemented as a torsion spring, against the rocker arm 17, so that said rocker arm is in the blocked position and the latching is still in a relaxed state, i.e. there is no contact between the end 12 of the blocking pawl 8 and the stopping face 13 implemented as a roller 7. After termination of the reset operation described it is possible to return the latching mechanism to the ON position since the unlatching mechanism 3 is once again in the tensioned state.

Figure 13:
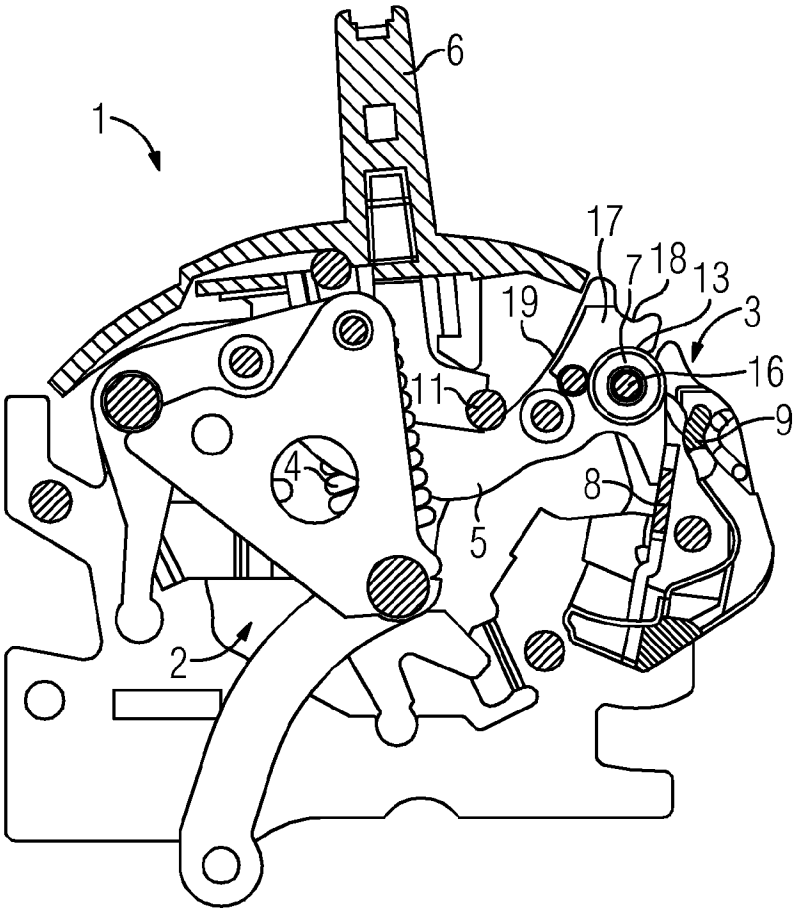
FIGS. 12 and 13 show a latching mechanism in the tripped position.
Figure 12:
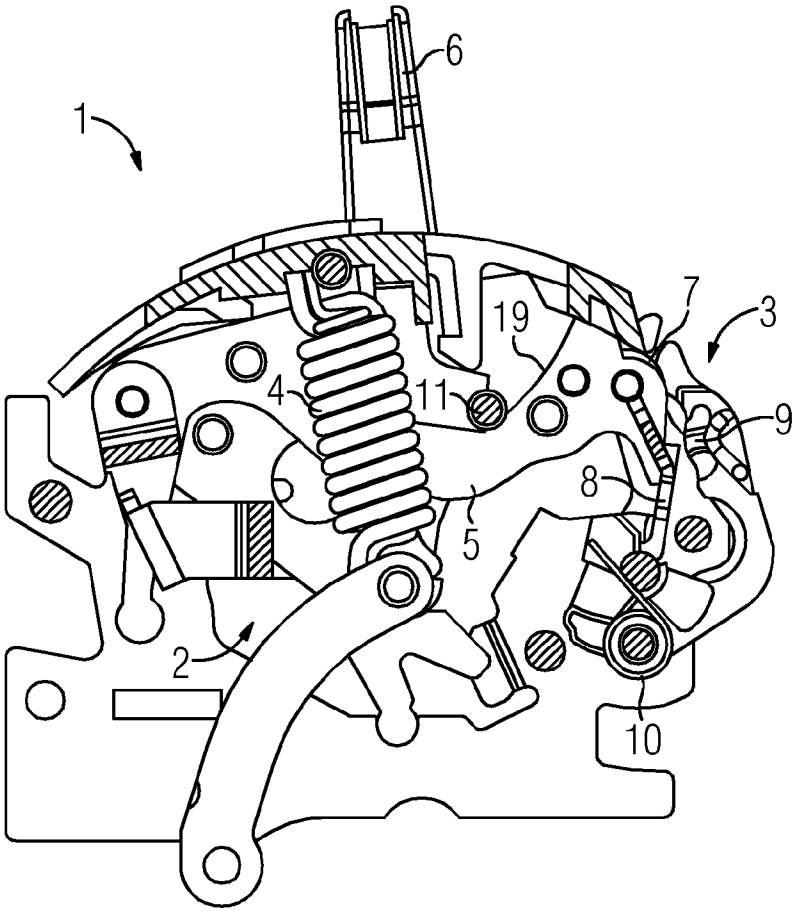

FIGS. 12 and 13 show the latching mechanism 1 of a circuit breaker in the tripped position. The tension lever 5 with the roller 7 mounted rotatably thereon has been transferred upward into its end position. In this case it bears on the tensioning bolt 11 which is mounted in the actuating lever 6. If the latching mechanism 1 is to be transferred from the tripped position back into the ON position, a reset operation must be performed once again in respect of the latching mechanism 1, in particular the unlatching mechanism 3, such that the unlatching mechanism 3, and here in particular the catch spring 10, is tensioned and the tripping shaft 9 is returned to the initial position.

Figure 14:
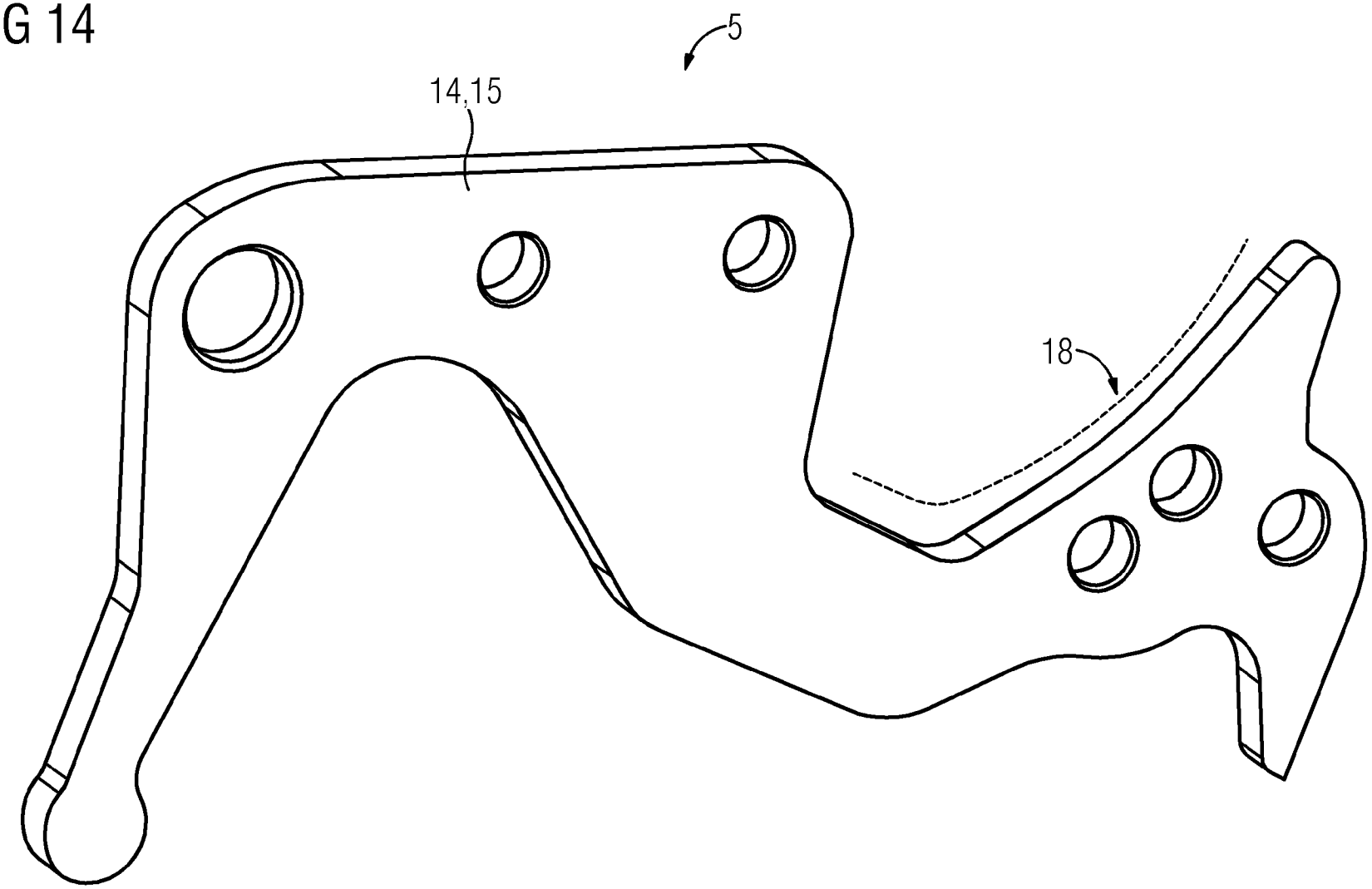
FIG. 14 shows a side part of the tension lever.

FIG. 14 shows a side part 14, 15 of a tension lever 5. Located between the two side parts 14, 15 in the installed state of the tension lever are inter alia the roller 7, the circumferential surface of which forms the stopping face 13 for the blocking pawl 8, and the mounting of the rocker arm 17. Here, the rocker arm 17 is swivelable such that it is swiveled between the two side parts 14, 15 during the reset operation and hence releases the reset contour 19 (FIG. 9) of the tension lever 5. During the reset operation, the tensioning bolt 11 connected to the actuating lever slides/rolls along the reset contour 19 and in this way presses the tension lever 5 downward.

Figure 15:
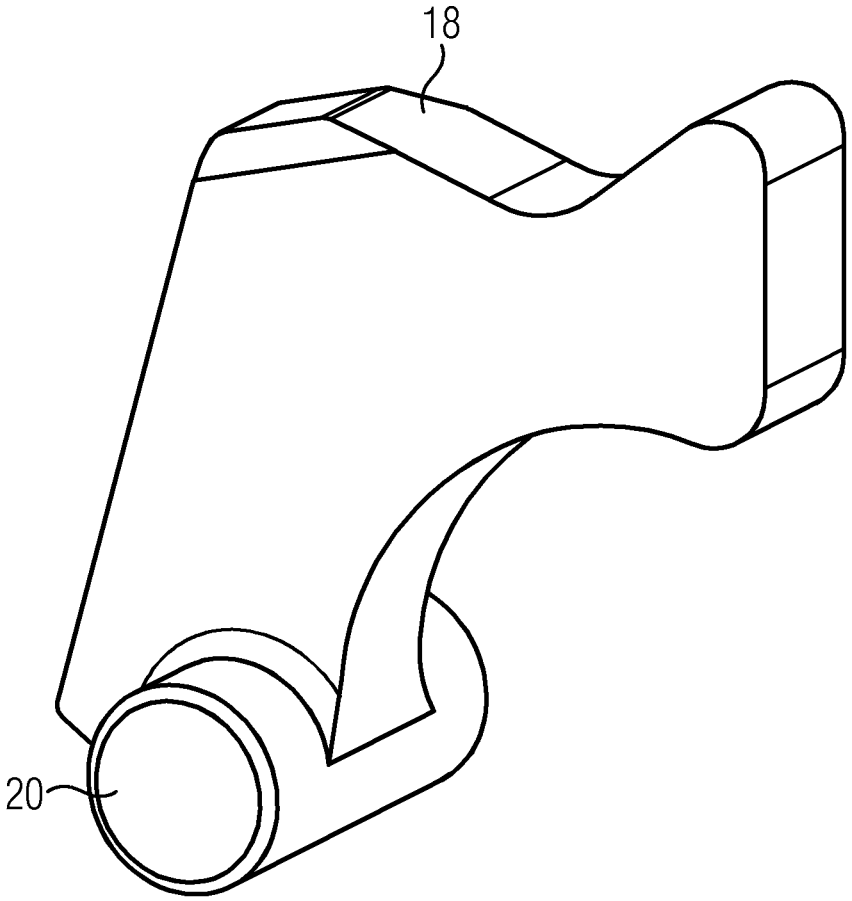
FIG. 15 shows a rocker arm.

FIG. 15 is a detailed view of the rocker arm 17 mounted movably on the tension lever 5 according to an embodiment of the invention. The rocker arm 17 comprises a bearing bolt 20 by means of which the rocker arm 17 is mounted rotatably in the tension lever 5 between the two side parts 14, 15 of the tension lever 5. Corresponding bearing bushes for receiving the bearing bolt are provided in the side parts 14, 15. In the upper region the rocker arm 17 comprises a blocking contour 18 onto which the tensioning bolt 11 connected to the actuating lever 6 runs in the OFF position of the latching mechanism 1 and thereby presses the tension lever 5 slightly downward. In this way the latching between the tension lever and the blocking pawl is relieved of load.

Figure 16:
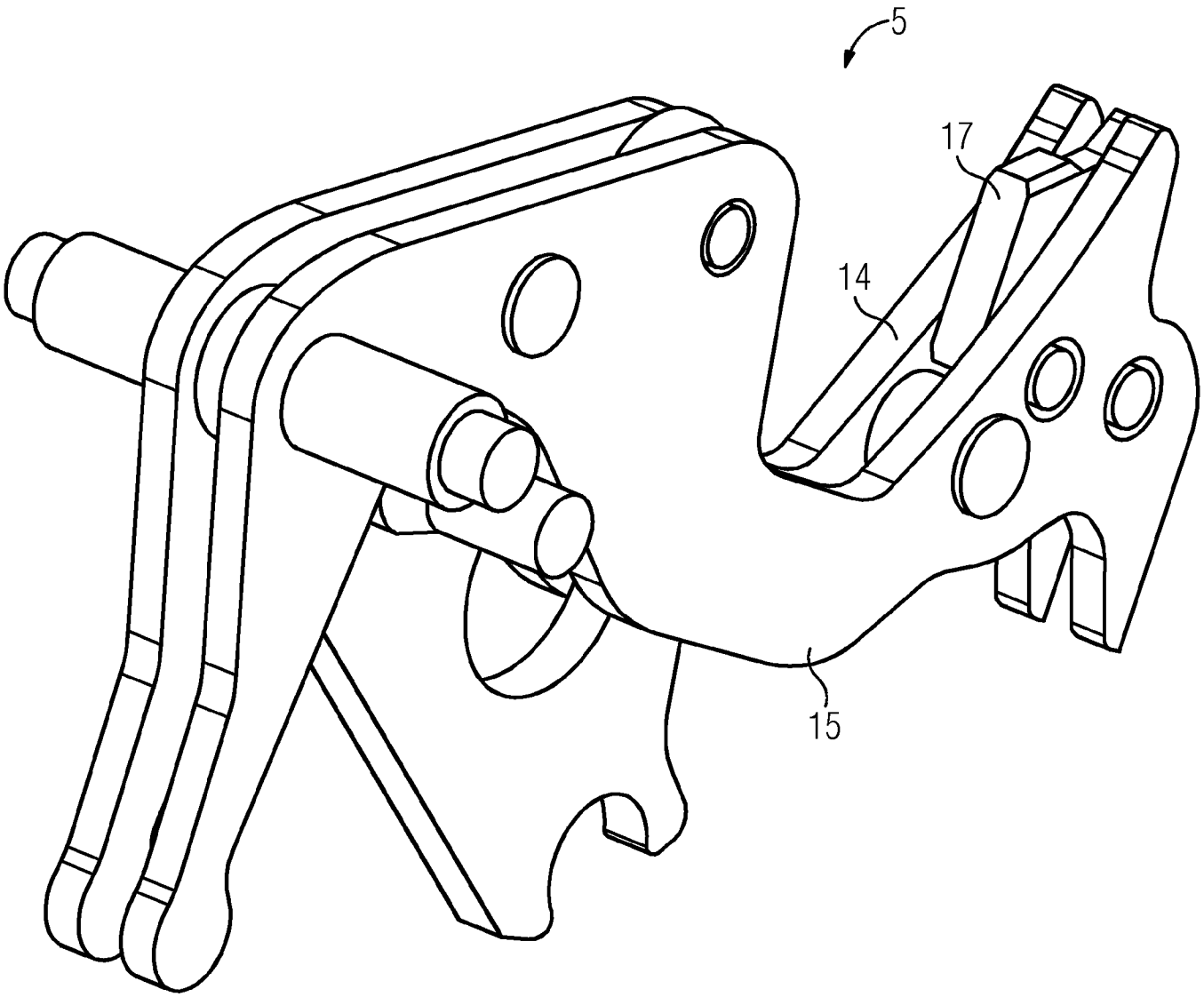
FIG. 16 shows a tension lever assembly with rocker arm mounted rotatably therein.

Finally, FIG. 16 shows a tension lever 5 in the assembled state. The rocker arm 17 provided according to an embodiment of the invention, which is mounted rotatably between the side parts 14, 15 in the tension lever, can be clearly seen in the rear area. During the reset operation of the latching mechanism the rocker arm 17 is swiveled between the side parts 14, 15 of the tension lever 5 and hence the reset contour 19 for the tensioning bolt 11 is not blocked.

By way of the rocker arm 17 provided on the tension lever 5 of a latching mechanism 1 according to an embodiment of the invention it is reliably ensured that, in the OFF position of the latching mechanism 1, the test button can be pressed or the tripping shaft actuated without the latching mechanism or the switch being tripped.

Owing to the provision of the rocker arm 17 on the tension lever 5, which rocker arm 17 is required exclusively to prevent the latching mechanism being tripped in the OFF position, the position of the pivot point and the blocking contour are freely selectable. This enables the rocker arm 17 to be used in different latching mechanisms 1 irrespective of the latching mechanism kinematics in each particular case.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims.

Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A circuit breaker, comprising:

a latching mechanism including a switching mechanism for opening and closing a switch contact which is operatively connected to a tensioning element; and an unlatching mechanism by which, in response to a tripping signal, the tensioning element is transferrable from a tensioned state into an at least substantially relaxed state in such a way that the switch contact is opened thereby, the tensioning element being indirectly coupled to a tension lever which is lockable or trippable as a function of a position of a blocking pawl of the unlatching mechanism and which includes a blocking mechanism by which, in an OFF position of the latching mechanism, in which the switch is open and the tensioning element is tensioned, tripping of the tension lever is prevented, the blocking mechanism of the tension lever including a rocker arm fastened movably on the tension lever, wherein, upon being transferred into the OFF position, the rocker arm is movable together with the tension lever such that the blocking pawl is removed from a stopping face of the tension lever.

2. The circuit breaker of claim 1, wherein, upon being transferred to the OFF position, the rocker arm is movable together with the tension lever such that the latching between blocking pawl and tension lever is relieved of load.

3. The circuit breaker of claim 1, further comprising an actuating lever, by which the latching mechanism is transferable into the OFF position, operatively connected to a tensioning bolt which, upon the latching mechanism being transferred into the OFF position, is brought into contact with a blocking contour of the rocker arm.

4. The circuit breaker of claim 1, wherein the tensioning element is a tension spring.

5. The circuit breaker of claim 1, wherein the rocker arm is fastened movably on the tension lever such that the rocker arm can be brought at least temporarily into an overlapping arrangement with the tension lever at least in sections.

6. The circuit breaker of claim 1, wherein the rocker arm is mounted in at least one of a rotatable and swivelable manner on the tension lever.

7. The circuit breaker of claim 6, wherein, upon being transferred to the OFF position, the rocker arm is movable together with the tension lever such that the latching between blocking pawl and tension lever is relieved of load.

8. The circuit breaker of claim 1, wherein, during a reset operation performed after tripping of the latching mechanism, in order to reactivate the unlatching mechanism, a force is applied to the rocker arm such that tripping of the tension lever is prevented despite a tripping signal.

9. The circuit breaker of claim 8, wherein the force is applied in order to swing the rocker arm into the engagement position via the blocking pawl.

10. The circuit breaker of claim 1, wherein the blocking pawl is operatively connected to a spring element.

11. The circuit breaker of claim 10, wherein the spring element is implemented as a torsion spring.

12. A circuit breaker, comprising:

a latching mechanism including a switching mechanism for opening and closing a switch contact which is operatively connected to a tensioning element; and an unlatching mechanism by which, in response to a tripping signal, the tensioning element is transferrable from a tensioned state into an at least substantially relaxed state in such a way that the switch contact is opened thereby, the tensioning element being indirectly coupled to a tension lever which is lockable or trippable as a function of a position of a blocking pawl of the unlatching mechanism and which includes a blocking mechanism by which, in an OFF position of the latching mechanism, in which the switch is open and the tensioning element is tensioned, tripping of the tension lever is prevented, the blocking mechanism of the tension lever including a rocker arm fastened movably on the tension lever, wherein, during a reset operation which is performed after tripping of the latching mechanism in order to reactivate the unlatching mechanism, the rocker arm is moved in such a way that a reset contour on the tension lever is freely accessible to an actuation element.

13. A circuit breaker, comprising:

a latching mechanism including a switching mechanism for opening and closing a switch contact which is operatively connected to a tensioning element; and an unlatching mechanism by which, in response to a tripping signal, the tensioning element is transferrable from a tensioned state into an at least substantially relaxed state in such a way that the switch contact is opened thereby, the tensioning element being indirectly coupled to a tension lever which is lockable or trippable as a function of a position of a blocking pawl of the unlatching mechanism and which includes a blocking mechanism by which, in an OFF position of the latching mechanism, in which the switch is open and the tensioning element is tensioned, tripping of the tension lever is prevented, the blocking mechanism of the tension lever including a rocker arm fastened movably on the tension lever, wherein, during a reset operation which is performed after tripping of the latching mechanism in order to reactivate the unlatching mechanism, the rocker arm is moved in such a way that a reset contour on the tension lever is freely accessible to an actuation element, and wherein, during the reset operation, a tensioning bolt can be brought at least temporarily into engagement with the reset contour, the reset contour being operatively connected to an actuating lever via which the reset operation is initiated.

* * * * *